US007625264B1

(12) United States Patent
Gordon

(10) Patent No.: US 7,625,264 B1
(45) Date of Patent: Dec. 1, 2009

(54) PNEUMATIC DRY WALL SANDER

(76) Inventor: Jeff Gordon, 2867 Holly Bay Rd., Orange Park, FL (US) 32073

( * ) Notice: Subject to any disclaimer, the term of this patent is extended or adjusted under 35 U.S.C. 154(b) by 0 days.

(21) Appl. No.: 12/235,971

(22) Filed: Sep. 23, 2008

(51) Int. Cl.
*B24B 23/03* (2006.01)
*B24B 55/06* (2006.01)

(52) U.S. Cl. ..... 451/294; 451/359; 451/456

(58) Field of Classification Search ..... 451/294, 451/295, 357, 359, 354, 456
See application file for complete search history.

(56) References Cited

U.S. PATENT DOCUMENTS

| | | | | |
|---|---|---|---|---|
| 3,785,092 | A | 1/1974 | Hutchins | |
| 4,765,099 | A | 8/1988 | Tanner | |
| 4,782,632 | A | 11/1988 | Matechuk | |
| 4,930,264 | A * | 6/1990 | Huang | 451/359 |
| 5,218,790 | A | 6/1993 | Huang | |
| D353,313 | S | 12/1994 | Stiles | |
| 5,605,500 | A | 2/1997 | Matechuk | |
| 6,007,412 | A * | 12/1999 | Hutchins | 451/295 |
| 6,049,941 | A | 4/2000 | Vollenweider, II | |
| 6,203,415 | B1 * | 3/2001 | Torrance-Castanza et al. | 451/359 |
| 6,468,141 | B1 | 10/2002 | Conboy et al. | |
| 6,860,799 | B2 | 3/2005 | Loveless | |
| 7,549,913 | B2 * | 6/2009 | Weiford et al. | 451/359 |

* cited by examiner

*Primary Examiner*—Robert Rose

(57) ABSTRACT

This invention is a pneumatically driven dry wall sander with the capability to create a vacuum to trap the dust, which is produced during the sanding operation, and then safely eject the dust away from the work site. A pneumatic motor that is operated by air will operate the sander and sanding disk and at the same time operate a set of impellers that create a slight vacuum. The air flow can be regulated so that the speed of the motor can be controlled depending on the specific need of the worker in performing sanding operations.

9 Claims, 3 Drawing Sheets

PNEUMATIC DRY WALL SANDER

BACKGROUND OF THE INVENTION

A. Field of the Invention

This device will be used in the construction trades and specifically when sanding a wall. Sanding the walls is necessary in the construction of new homes particularly prior to the application of paint on the interior walls and ceiling. In the past, electrical sanders have been used. Because of the amount of dust that is inevitably and unavoidably produced during the sanding process, electrical equipment wears out quickly because of the exposure to high levels of contaminants that enter into the electrical equipment.

B. Prior Art

There are many other references in the prior art related to dry wall sanders. A representative example is Conboy, U.S. Pat. No. 6,468,141. Another example is Loveless, U.S. Pat. No. 6,860,799. The Conboy device is a dry wall sander, which is operated using an electrical motor. The Loveless device is a vacuum-driven sander.

Neither of the above referenced devices operate using a pneumatic motor nor do either of the prior patent have a vacuum system to remove the dust that is produced.

Another example in the prior art related to dry wall sanders is Matechuk, U.S. Pat. No. 4,782,632. This device is a dry wall sander using an electrical motor with a vacuum system. It does not however combine the vacuum system with a pneumatic motor as this device. Additionally the combination is not made obvious in Matechuk.

BRIEF SUMMARY OF THE INVENTION

This is a pneumatically operated dry wall sander. It has the advantage of not requiring an electrical current or any electrical parts. This use of pneumatics saves a great deal of money and time during the sanding operation and saves time and money during the initial set up at the site.

Extensive electrical cords are not needed and there is never any danger of not being able to access power at the construction site. A compressor is needed to operate this sander but the power source for the compressor is usually a small engine, which is part of the compressor.

During the sanding process, it is very common to have dust and other items impact all parts of the drywall sanding equipment including the operator of the equipment. Unfortunately, the effect of an excessive amount of dust on electrical equipment is to shorten the useful life of the electrical tool, including a drywall sander. Dust will collect on the armature of the electrical motor, the brushes of the electrical motor and short its life expectancy.

Additionally, the dust will also impact the user of the device and result in greatly reduced productivity as well as general skin irritation and other possible health hazards. As the dust is literally flying the dust will cake on the user and the user will be forced to take multiple breaks to clean his or her eyes. Safety goggles are not useful to combat this problem because the dust simply accumulates on the goggles. This results in frequent breaks and a great deal of down time with a resultant loss of productivity.

Additionally the inhalation of drywall dust may be associated with health problems and the vacuum system in this device would greatly reduce the possibility of health problems for the workers.

It is an object of this device to have a pneumatically operated dry wall sander, which would remove the necessity of having a source of electrical current while at the same time vacuuming the dust that is produced in the sanding process and distributing the dust to a remote location.

It is a further object to make a device, which is safer for the user in terms of general productivity as well as health issues.

REFERENCE NUMBERS

Figure 1:
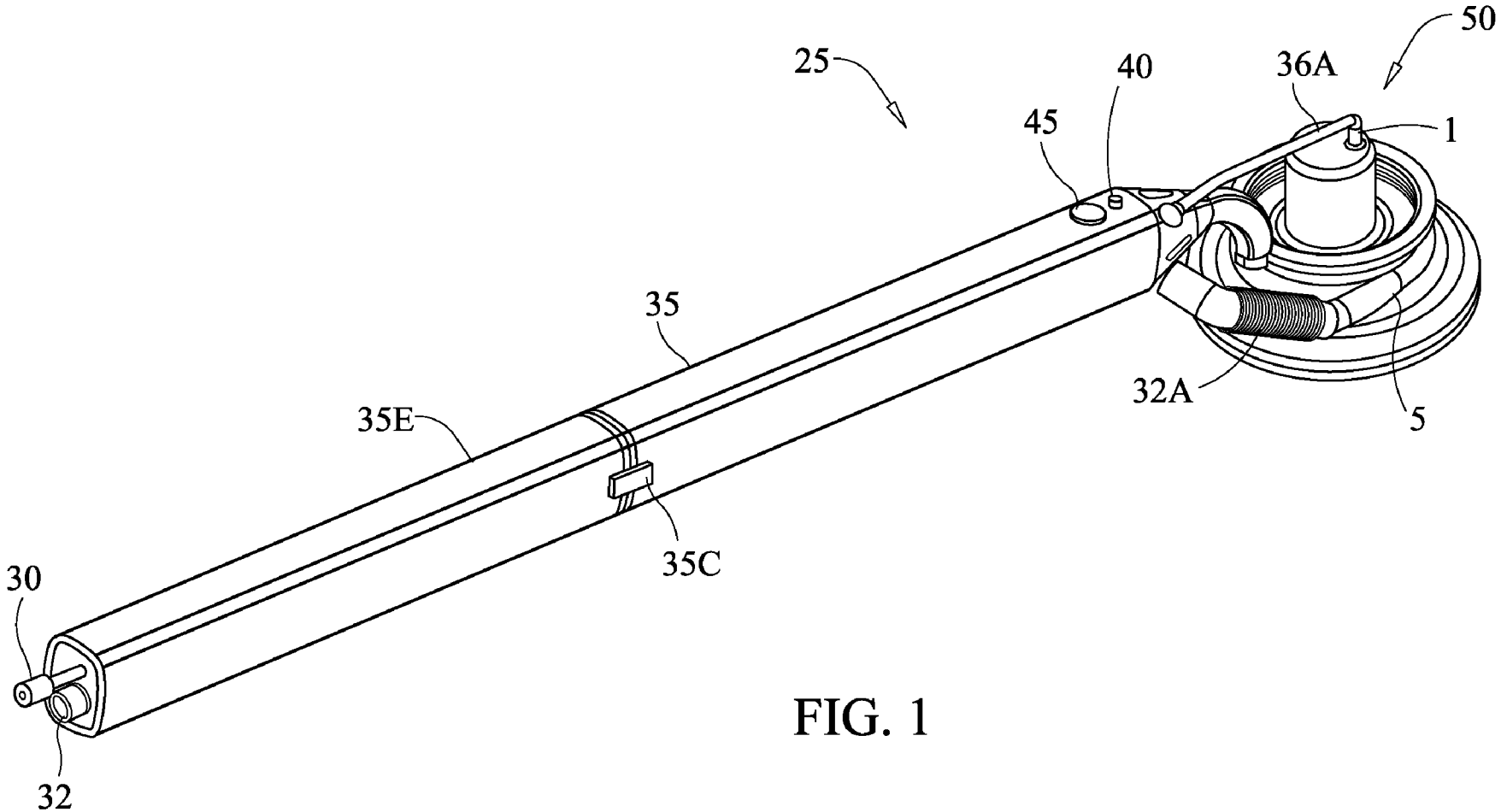
FIG. 1 is an isometric view of the device from the handle to the motor.
Figure 2:
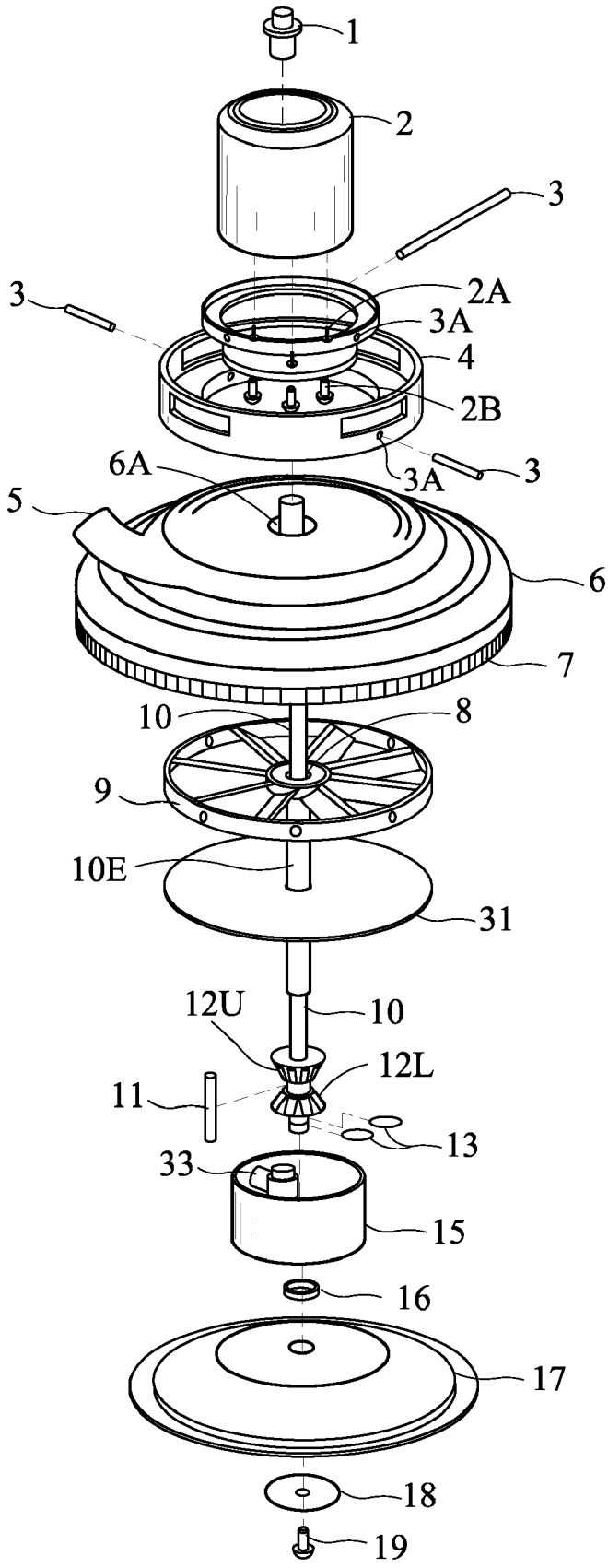
FIG. 2 is an exploded view of the pneumatic sander.
Figure 3:
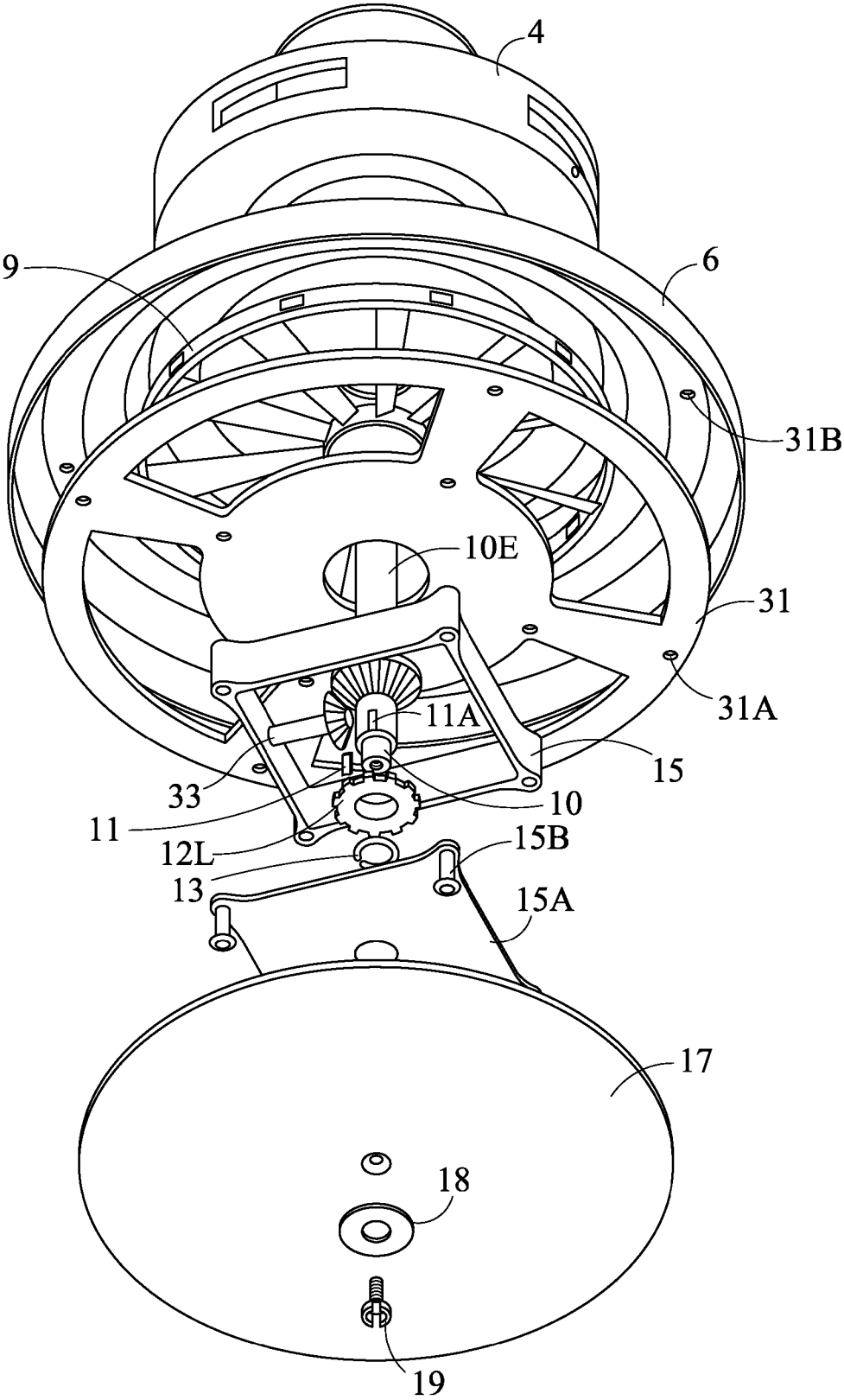
FIG. 3 is an exploded view of the drive assembly of the sander.

| | |
|---|---|
| 1 | Air fitting |
| 2 | Pneumatic air motor |
| 2A | Motor collar |
| 2B | Means to mount motor collar to motor |
| 3 | Pivot pin |
| 3A | Holes on Collar |
| 4 | Gimbal mount housing |
| 5 | Dust exhaust port |
| 6 | Impeller housing |
| 6A | Impeller opening |
| 7 | Brushes |
| 8 | Impeller bearing |
| 9 | Impeller |
| 10 | Central drive shaft |
| 10E | External drive shaft |
| 11 | Cotter pin |
| 11A | Cotter pin keyway |
| 12U | Upper horizontal drive gear |
| 12L | Lower horizontal drive gear |
| 13 | Retaining clip |
| 15 | Gear Housing |
| 15A | Second housing plate |
| 15B | Mounting means for gear housing |
| 16 | Bearing |
| 17 | Sanding disc |
| 18 | Washer |
| 19 | Disc bolt |
| 25 | Device |
| 30 | Air supply line |
| 36A | Air supply line at motor |
| 31 | Mounting plate |
| 31A | Holes in mounting plate |
| 31B | Impeller Mounting Hole |
| 32 | Dust Portal |
| 32A | Dust tubing |
| 33 | Stationary gear |
| 35 | Handle |
| 35A | Extension section |
| 35C | Means to connect extension |
| 40 | Air adjustment |
| 45 | Pressure Gauge |
| 50 | Sander Assembly |

DETAILED DESCRIPTION OF THE EMBODIMENTS

This device 25 is a pneumatically operated sander with the added feature of vacuuming the dust that is generated during the sanding process. Pneumatic tools, in general, are common in the prior art as well as pneumatic sanders. However, in addition to performing the sanding functions the device will also create a slight vacuum that will capture the dust and discard it without interfering with the operation of the sander.

The sander assembly 50 is attached to a handle 35 that allows the person to maneuver the sander while on the wall to be sanded. Within the handle 35 will be flexible tubing to supply 30 air to the sander and flexible tubing to exhaust 32 the dust. Both the air supply and the exhaust port will be attached to respective portions of the casing.

Extension members 35E may be connected to the handle 35 and used with this device to extend the length of the device. A means to connect the sections 35C is also provided. Air supply tubing 30 will be placed in the interior of the extension member to allow the flow of air through the extension member to air supply tubing 36A located at the sander and through the air fitting 1 attached to the pneumatic motor 2. Similarly dust exhaust tubing 32A, which mates with a dust exhaust port 5 on the sander 50 allows the dust to be ejected through the exhaust port 32.

The extension members 35 will likely be hollow plastic pieces that allow the air to be supplied to the pneumatic motor and allow the dust to be expelled from the device.

The air fitting 1 will direct the air into the pneumatic motor 2. The pneumatic motor 2 is powered by a source of compressed air that will be produced by an air compressor (not depicted). Air compressors are common in the prior art and are frequently used to operate pneumatic tools.

In order for the operator to vary the speed of the pneumatic motor a means to adjust the air flow 40 will be included. This may include a throttle valve or butterfly valve although there are many ways to adjust the flow of air into a device. Additionally a pressure gauge 45 will also be included to allow the operator to monitor the operation of the sander in this fashion.

The motor 2 will rest on a collar 2A that is secured to a gimbal mount housing 4 that will allow the motor to tilt and swivel depending of the contours of the surface that is being sanded so as to properly position the sanding disk 17 on the wall to be sanded. Holes 3A on the collar 2A and the gimbal mount housing 4 allow pivot pins 3 to be placed through openings in the gimbal mount housing 4 to secure the gimbal mount housing 4 to the collar 2A. A means to secure 2B the collar 2A to the pneumatic motor will also be provided. This means to secure is probably a plurality of bolts.

At one end of the pneumatic motor will be a central drive shaft 10. The central drive shaft 10 will extend from one end of the motor to the sanding disc 17 and will rotate at the same speed as the motor.

The central drive shaft 10 will pass through an opening 6A on the top of the impeller blade assembly 9 and through the opening in the bearing 8 that is in the center of an impeller blade assembly 9.

An external drive shaft 10E will be attached at one end to the bearing 8 in the center of the impeller and the central drive shaft 10 will pass through the center of the eternal drive shaft 10E. One end of the external drive shaft 10E will be connected to the impeller bearing and the other will secure the upper horizontal drive gear 12U.

The impeller blade assembly will be circular and will contain a series of impeller vanes of predetermined shape. The impeller blade assembly 9, when the device is assembled will be covered by the impeller housing 6, which is larger in diameter than the impeller blade assembly 9.

A mounting plate 31 will be secured to a portion of the impeller housing 6 and will partially cover the impeller blade assembly. The mounting will have a predetermined shape but will have open spaces on a portion of the plate in order to promote a flow of air through the impeller blades. Holes in the mounting plate 31A will allow the means to mount, probably a screw (not depicted) to secure the mounting plate to the impeller assembly through the use of impeller mounting holes 31B.

When the device is assembled the impeller ring 9 will be positioned in the interior of the impeller housing 6 and covered partially by the mounting plate 31 but sufficient space will be provided so that the impeller will be allowed to rotate freely. The means to secure the mounting plate will likely be a series of screws or bolts.

A gear housing 15 will be mounted to the mounting plate 31. The purpose of the gear housing is to protect the internal gear mechanism from dust and other contaminants. Attached to the one surface of the interior of the gear housing 15 is a stationary gear 33. Two gears, an upper horizontal gear 12U and a lower horizontal gear 12L will mate with the teeth of the stationary gear 33 inside the gear housing. The gears are designed to rotate and stay in contact during the operation of this device.

The upper horizontal gear 12U will be secured to an external drive shaft 10E that extends from the impeller bearing to the upper horizontal gear 12U and surrounds the central drive shaft 10. One end of the external drive shaft will have a key hole insert 11A into which a key 11 will be inserted. The key 11 will secure the external drive shaft 10E to the lower horizontal drive gear 12L, which will have a key slot into which a portion of the key will be inserted.

The lower horizontal gear 12L will rotate at the same speed as the motor and will mate with the stationary gear 33 on the inside of the gear housing 15. As this lower gear 12L rotates it will rotate the stationary gear 33 that is connected to the upper horizontal gear 12U that in turn will rotate the upper horizontal gear 12U in the opposite direction from the rotation of the sander disc because of the placement of the gears.

The lower horizontal gear 12L is attached to a portion of the central drive shaft 10 and external drive shaft 10E by the key. One end of the external drive shaft 10E is connected to the impeller ring and as the lower horizontal gear turns, it will cause the impeller ring 9 to rotate in the opposite direction from the rotation of the sanding disc that is attached to the central drive shaft 10.

In order to insure that the relative positions of the gears are maintained within the housing, one or more retaining pins or clips 13 may be used. In order to protect the gears from contamination a second housing plate 15A is provided; a lubricant may also be provided within the gear housing to protect the gears. When it is assembled the gear housing will be mounted to one side of the mounting plate 31 and will be enclosed by the second housing plate 15A. A means to secure 15B the second housing plate 15A to the gear housing and the mounting plate will be provided; it is anticipated that a plurality of bolts or screws are used to secure the housing.

The rotation of the impeller ring 9 will create a slight vacuum within the impeller housing and will allow the dust to be collected and eventually routed to the exhaust port 5 and eventually disposed through the exhaust tubing 32A and exhaust port 32.

The sanding disc 17 is secured with a disc bolt 19 that is mated to a set of internal threads that are found on the end of the central drive shaft. During the operation of this device, the sanding disc can be easily replaced by unscrewing the bolt and replacing the disc without disturbing the impeller ring or gear mechanism.

Around the perimeter of the impeller housing 6 will be a series of flexible brushes 7. The purpose of the brushes is to capture the dust as it is generated while using the sander. When the device is operated the brushes would be placed against the wall as the device is used.

As the dust is generated and due to the vacuum that is created by the impeller ring the dust will travel in the direction of vacuum and eventually be directed to an exhaust port duct 5 that is part of the impeller casing 6. An exhaust hose 32A is attached to the exhaust port duct 5.

The inventor claims:

1. A pneumatic dry wall sander, which is comprised of:

a. a handle;

wherein a handle of a predetermined shape is provided;

wherein tubing is provided in the handle for an air supply line;

wherein dust exhaust tubing is provided in the handle;

b. extension members;

wherein extension members may be attached to the handle;

said extension members provide air supply tubing and dust exhaust tubing;

wherein the air supply tubing in the extension members aligns with the air supply tubing in the handle;

wherein the dust exhaust tubing aligns with the dust exhaust tubing in the handle;

c. impeller casing;

wherein an impeller casing for a sander is provided;

wherein the impeller casing is of a predetermined shape;

d. a pneumatic motor;

wherein a pneumatic motor is mounted to the top of the sander;

e. air supply;

wherein a supply of compressed air is provided;

wherein an air supply line is connected to the air supply source;

wherein the air supply can be adjusted;

said air supply operates the pneumatic motor;

f. gimbal housing;

wherein a gimbal housing is provided;

wherein the motor is secured to the gimbal housing;

wherein a plurality of pivot pins are provided;

said gimbal housing allows the sander to tilt;

g. central drive shaft;

wherein the central drive shaft has a first end and a second end;

wherein the first end is secured to the pneumatic motor;

wherein the second end secured the sanding disc;

wherein internal threads are provided on the end of the central drive shaft to secure the sanding disc;

h. impeller blade assembly;

wherein an impeller blade assembly is provided;

wherein the impeller blade assembly will be covered by the casing for the sander;

wherein a series of impeller blades is provided;

wherein an opening is provided in the impeller blade assembly;

wherein a bearing is placed in the center of the impeller blade assembly;

wherein the central drive shaft passes through the bearing in the impeller blade assembly;

i. external drive shaft;

wherein an external drive shaft is secured to one end to the impeller bearing;

said external drive shaft surrounds the central drive shaft;

wherein a keyway is located on one end of the external drive shaft;

j. a mounting plate;

wherein an opening in the center of the mounting plate is provided;

wherein the external drive shaft passes through the opening in the mounting plate;

wherein the mounting plate is secured to the underside of the casing;

wherein the mounting plate has a predetermined shape;

wherein the mounting plate partially covers the impeller blade assembly;

k. gear housing;

wherein a gear housing is provided;

wherein a stationary gear is mounted to the side of the interior of the gear housing;

wherein the gear housing is secured to the mounting plate;

wherein a second gear housing plate is provided;

k. upper horizontal drive gear;

wherein an upper horizontal drive gear is attached to the external drive shaft;

wherein the teeth on the upper horizontal drive gear mesh with the teeth on the stationary gear;

l. lower horizontal drive gear;

wherein a lower horizontal drive gear is attached to the central drive shaft;

wherein the teeth on the lower horizontal drive gear mash with the teeth of the stationary gear;

m. means to connect the lower horizontal drive gear to the external drive shaft;

n. sanding disc;

wherein a sanding disc is provided;

wherein the sanding disc is of a predetermined shape;

wherein a means to secure the sanding disc is provided;

o. brushes;

wherein a plurality of brushes are secured to the casing;

wherein the brushes completely surround the perimeter of the casing;

p. dust exhaust port;

wherein a dust exhaust port is provided;

said dust exhaust port is part of the impeller casing;

wherein dust tubing is provided;

said tubing is secured to the exhaust port.

2. The device as described in claim 1 wherein the air supply hose is flexible.

3. The device as described in claim 1 wherein the vacuum hose is flexible.

4. The device as described in claim 1 wherein the handle is further comprised of a means to shorten or extend the length.

5. The device as described in claim 1 wherein the means to connect the external drive shaft to the central drive shaft is a keyway insert.

6. The device as described in claim 1 wherein the brushes are flexible.

7. The device as described in claim 1 wherein the means to regulate the air supply is a butterfly valve.

8. The device as described in claim 1 wherein the means to regulate the air supply is a throttle valve.

9. The device as described in claim 1 wherein a pressure gauge is provided.

* * * * *